US006520168B2

(12) United States Patent
Ishii et al.

(10) Patent No.: US 6,520,168 B2
(45) **Date of Patent: *Feb. 18, 2003**

(54) AIR-FUEL RATIO CONTROLLER FOR ENGINE

(75) Inventors: Toshio Ishii, Mito (JP); Yutaka Takaku, Mito (JP)

(73) Assignee: Hitachi, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/800,660

(22) Filed: Mar. 8, 2001

(65) Prior Publication Data

US 2001/0008990 A1 Jul. 19, 2001

Related U.S. Application Data

(63) Continuation of application No. 09/365,812, filed on Aug. 2, 1999, now Pat. No. 6,286,494.

(30) Foreign Application Priority Data

Jul. 31, 1998 (JP) ..... 10-217355

(51) Int. Cl.[7] ..... F02B 75/08
(52) U.S. Cl. ..... 123/695; 123/696; 60/276
(58) Field of Search ..... 123/696, 695; 60/276

(56) References Cited

U.S. PATENT DOCUMENTS 5,785,037 A * 7/1998 Maki et al. ..... 123/696
5,867,983 A * 2/1999 Otani ..... 123/696
5,927,260 A * 7/1999 Kishimorto et al. ..... 123/696
5,941,223 A * 8/1999 Kato ..... 123/696
6,026,795 A * 2/2000 Poggio et al. ..... 123/696

* cited by examiner

*Primary Examiner*—John Kwon
(74) *Attorney, Agent, or Firm*—Crowell & Moring LLP

(57) ABSTRACT

An air-fuel ratio correction coefficient calculating component is provided to an air-fuel ratio controller for an engine having the wide range air-fuel ratio sensor. In order to compensate for a time lag in detection of an air-fuel ratio detected by the wide range air-fuel ratio sensor from the time when a mixed gas of the air-fuel ratio is supplied to the engine, the air-fuel ratio controller includes a component for calculating an air-fuel ratio correction coefficient to control an amount of fuel supplied to the engine based on an output signal of the air-fuel ratio sensor. The air-fuel ratio correction coefficient calculating component calculates the air-fuel ratio correction coefficient based on a nonlinear calculation element. The non-linear calculation element has an ON-OFF characteristic, a neutral zone characteristic, a saturation characteristic or a characteristic combining a plurality of characteristics selected from the above-mentioned characteristics.

4 Claims, 7 Drawing Sheets

AIR-FUEL RATIO CONTROLLER FOR ENGINE

This application is a continuation of application Ser. No. 09/365,812 filed Aug. 2, 1999; U.S. Pat. No. 6,786,494.

BACKGROUND OF THE INVENTION

The present invention relates to an air-fuel ratio controller of an engine having an air-fuel ratio correction coefficient calculating means and, more particularly, to an air-fuel ratio controller of an engine having an air-fuel ratio correction coefficient calculating means coping with a time-lag in detection of an air-fuel ratio detected by a wide range air-fuel ratio sensor.

In a case where an oxygen concentration in an exhaust gas of an engine is detected by an air-fuel ratio sensor, and an air-fuel ratio of a mixed gas to be supplied to the engine is controlled to a preset value, for example, to a value near the theoretical air-fuel ratio by feeding back the detected value, response of the air-fuel ratio correction control is improved by calculating an air-fuel ratio correction coefficient in taking into consideration a time lag from the time when fuel is injected by an injector and burned to the time when an oxygen concentration is detected. Such a technology is disclosed, for example, in Japanese Patent Application Laid-Open No.5-288105. As a means for solving the problem of the time lag described above, a technology of improving control response at normal operation by correcting a preset air-fuel ratio using a model of a dead time and a first-order time lag constant and a technology of improving control response at transient operation by correcting an air-fuel ratio control parameter changing a throttle opening are proposed.

Further, a technology for solving the problem of the time lag in response of correcting air-fuel ratio is proposed in Japanese Patent Application Laid-Open No.8-74624. The technology is that in an air-fuel ratio controller for an engine, when an air-fuel ratio correction coefficient for setting a fuel amount supplied to the engine is calculated, the problem of the time lag in response of correcting air-fuel ratio is solved by performing PI control (proportional control and integral control) based on a detected value of oxygen concentration detected by an 02 sensor, that is, by performing proportional control (proportional correction) based on the detected value and then performing integral control (integral correction) by increasing the integral coefficient corresponding to elapsed time.

The former conventional technology described above has disadvantages in that a large number of man-hours required in matching work such as model setting and sharing among parameters when constant matching work is performed for each system to be adjusted, and that an error is difficult to be corrected when the error is produced in the model due to deterioration over time.

The latter conventional technology described above has a disadvantage in that the method can not calculate any air-fuel ratio correction coefficient for PI control based on an air-fuel ratio value (linear detected value) detected by a wide range air-fuel ratio sensor because the method is PI control (proportional control and integral control) based on a detected value (ON-OFF detected value) of oxygen concentration detected by an $O_2$ sensor.

Therefore, even if the PI control based on the air-fuel ratio value detected by the $O_2$ sensor is applied to an air-fuel ratio correction coefficient calculating means using the wide range air-fuel ratio sensor, the following problems occur. That is, since an output from the wide range air-fuel ratio sensor has a time lag to the change in an air-fuel ratio supplied to the engine and an amplitude of the output is averaged to become small, as shown in FIG. 8(*a*), a time lag as shown by a dashed line in FIG. 8(*b*) occurs when the air-fuel ratio control by PI control is performed. As a result, an appropriate air-fuel ratio correction coefficient can not be calculated, and response of the air-fuel ratio correction control is deteriorated, and problems occur in the engine output and the exhaust gas cleaning. It can be considered that a means for solving the time lag in control is to increase a control gain. However, in this case, a problem such as increase of overshoot or occurrence of oscillation may be occur.

SUMMARY OF THE INVENTION

The present invention is to solve the problems described above, and an object of the present invention is to provide an air-fuel ratio correction coefficient calculating means which can cope with a time lag in detection of an air-fuel ratio detected by a wide range air-fuel ratio sensor from the time when a mixed gas of the air-fuel ratio is supplied to an engine in an engine air-fuel ratio controller having the wide range air-fuel ratio sensor.

In order to attain the above object, an air-fuel ratio controller for an engine in accordance with the present invention is characterized by comprising a wide range air-fuel ratio sensor for outputting a signal corresponding to an air-fuel ratio of an exhaust gas; and a means for calculating an air-fuel ratio correction coefficient to control an amount of fuel supplied to the engine based on an output signal of the air-fuel ratio sensor, wherein the air-fuel ratio correction coefficient calculating means calculates the air-fuel ratio correction coefficient based on a non-linear calculation element.

A detailed feature of the air-fuel ratio controller for an engine in accordance with the present invention is that the non-linear calculation element has an ON-OFF characteristic, a neutral zone characteristic, a saturation characteristic or a characteristic combining a plurality of characteristics selected from the above-mentioned characteristics.

Another detailed feature of the air-fuel ratio controller for an engine in accordance with the present invention is that the air-fuel ratio correction coefficient calculating means comprises means for calculating a target air-fuel ratio; a means for calculating a real air-fuel ratio based on the output signal of the wide range air-fuel ratio sensor; a means for calculating an air-fuel ratio difference by comparing the target air-fuel ratio and the real air-fuel ratio; and a control means for calculating an air-fuel ratio correction coefficient based on the air-fuel ratio difference, wherein the control means calculates the air-fuel ratio correction coefficient based on the air-fuel. ratio difference by at least one control out of a proportional control, an integral control and a differential control, and at least one of the proportional control and the integral control calculates the air-fuel ratio correction coefficient based on a non-linear calculation element.

The air-fuel ratio controller for an engine in accordance with the present invention constructed as described above can improve its control response by performing air-fuel ratio control by calculating an air-fuel ratio correction coefficient through the PID control such as a proportional-differential control system based on the difference between the real air-fuel ratio detected by the wide range air-fuel ratio sensor for outputting a real air-fuel ratio signal corresponding to the real air-fuel ratio in an exhaust gas of the engine and the target air-fuel ratio, and by providing the proportional component and the integral component with the non-linear calculation elements, and further can reduce man-powers of the matching work and maintain stability of the control system by limiting number of the parameters.

A further detailed feature of the air-fuel ratio controller for an engine in accordance with the present invention is that the air-fuel ratio correction coefficient calculating means has a non-linear calculation element correcting means, and the non-linear calculation element correcting means corrects the non-linear calculation element based on an output signal of an $O_2$ sensor arranged downstream of a catalyst or a time lag in response of the wide range air-fuel ratio sensor.

By the above-mentioned construction, deterioration of the exhaust gas condition of the exhaust gas exhausted from the downstream side of a catalyst due to deterioration of the catalyst can be minimized, and deterioration of the exhaust gas condition by mismatching of the air-fuel ratio correction coefficient due to a time lag in detection of the air-fuel ratio can be prevented.

DESCRIPTION OF THE PREFERRED EMBODIMENTS

An embodiment of an air-fuel ratio controller for an engine in accordance with the present invention will be described below, referring to the accompanied drawings.

Figure 1:
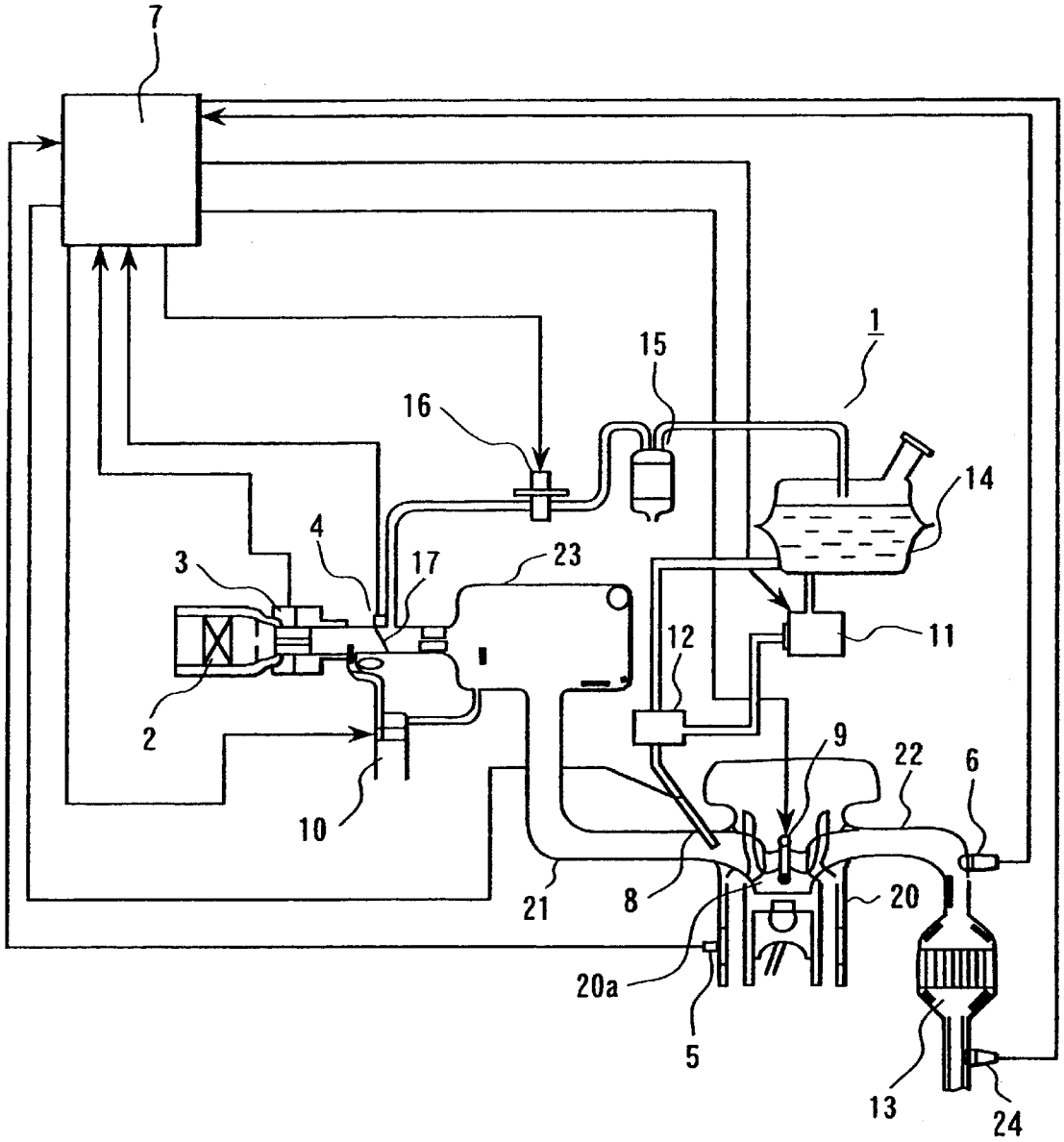
FIG. 1 is a diagram showing the total configuration of an engine control system having an embodiment of an air-fuel ratio controller for an engine in accordance with the present invention.

FIG. 1 shows the total configuration of a control system of an engine 1 having the present embodiment of an air-fuel ratio controller. Referring to FIG. 1, air to be sucked into the engine 1 is taken in through an air cleaner 2, passes through an air flow sensor 3 for detecting an amount of the intake air, further passes through a portion of a throttle valve 17 for controlling the amount of the intake air, and then enters into a collector 23. The air sucked into the collector 23 is distributed to each of intake pipes 21 connected to each of cylinders 20 of the engine 1 to be conducted to a combustion chamber 20*a* inside the cylinder 20. The throttle valve 17 can be rotated by a motor, not shown. The exhaust gas after combustion in the combustion chamber 20*a* flows into a catalyst 13 through an exhaust gas pipe 22 to clean harmful components in the exhaust gas and then is discharged to the external.

A throttle valve opening sensor 4 is arranged in the air intake side, a cooling water temperature sensor 5 is arranged in the cylinder 20, an air-fuel ratio sensor 6 is arranged in the exhaust pipe 22, and an $O_2$ sensor 24 is arranged downstream of the catalyst 13.

A detected value of each of the air flow sensor 3, the throttle valve opening sensor 4, the cooling water temperature sensor 5, the air-fuel ratio sensor 6, and the $O_2$ sensor 24 is input to a control unit 7 (hereinafter, referred to as ECU), and the ECU 7 performs air-fuel ratio control of a mixed gas supplied to the engine 1, ignition control and idle speed control (hereinafter, referred to as ISC).

On the other hand, fuel such as gasoline or the like is pumped from a fuel tank 14 by a fuel pump 11, kept at a preset pressure by a fuel pressure regulator 12, and supplied from an injector 21 to the combustion chamber 20*a* through the intake pipe 21. Evaporated gas produced in the fuel tank 14 is once adsorbed to a canister 15, and purged to the intake system of the engine at a normal operating state. A purged amount is controlled by a purge control valve 16.

Although a flow rate of the intake air is adjusted by the throttle valve 17, air bypassing the throttle valve 17 is adjusted by an ISC valve 10 to control rotating speed at idling. The supplied fuel and air are formed in a mixed gas to flow into the combustion chamber 20*a* of the engine 1 and ignited by a spark plug 9 to be burned.

The $O_2$ sensor 24 detect whether the air-fuel ratio is lean or rich, and the air-fuel ratio sensor 6 outputs a signal corresponding to an oxygen concentration in the exhaust gas after combustion. Since the oxygen concentration is determined by the air-fuel ratio of the supplied mixed gas, an actual air-fuel ratio can be detected by a signal of the air-fuel ratio sensor 6.

Figure 2:
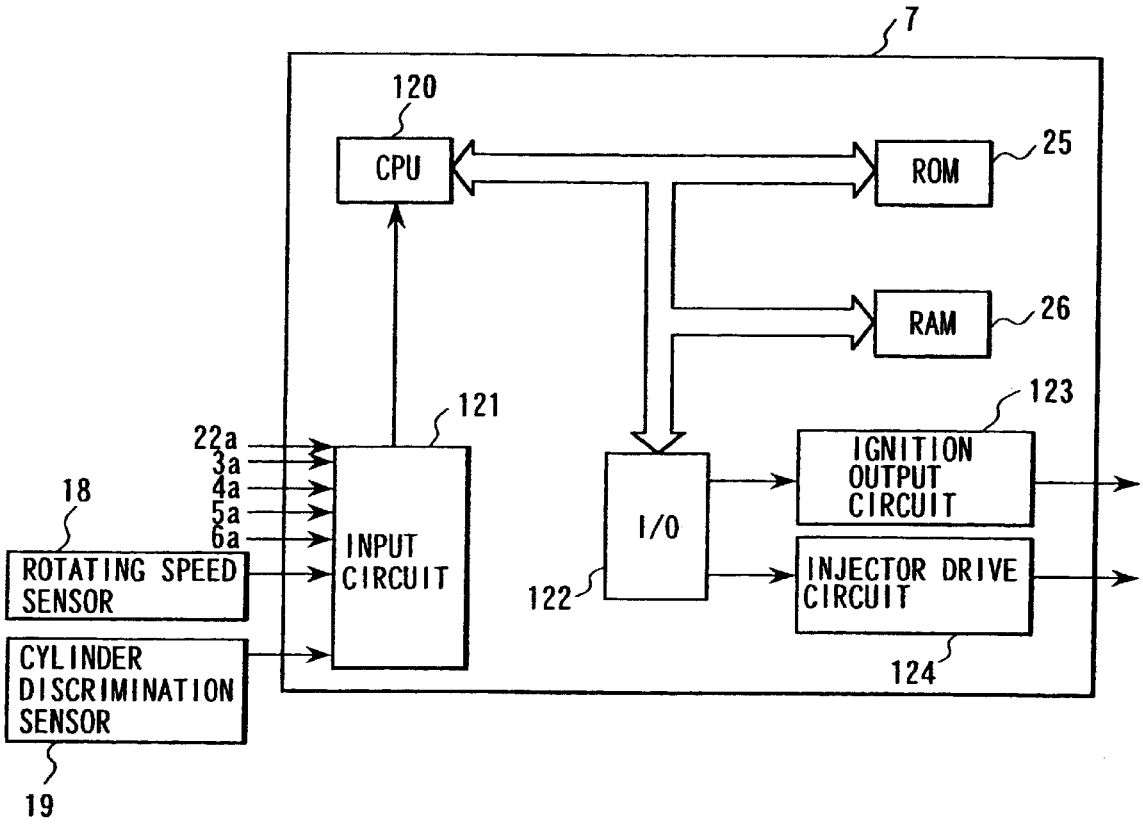
FIG. 2 is a diagram showing the inner configuration of the air-fuel ratio controller for an engine of FIG. 1.

FIG. 2 shows the inner configuration of the control unit (ECU) 7, signals 3*a*, 4*a*, 6*a*, 6*a*, 22*a* of the air flow sensor 3, the throttle valve opening sensor 4, the cooling water temperature sensor 5, the air-fuel ratio sensor 6, and the $O_2$ sensor 24 and signals of a rotating speed sensor 18 and a cylinder discrimination sensor 19 are input to an input circuit 121. A CPU 120 in the control unit (ECU) 7 reads these input signals and performs calculation processing based on a program and constants stored in a ROM 25. Further, an ignition timing and an injector drive pulse width of results of the calculation processing are output to an ignition output circuit 123 and an injector drive circuit 124 through an I/O 122 to perform ignition and fuel injection, respectively. A RAM 26 is used to store values of the input signals and the calculation results.

Figure 3:
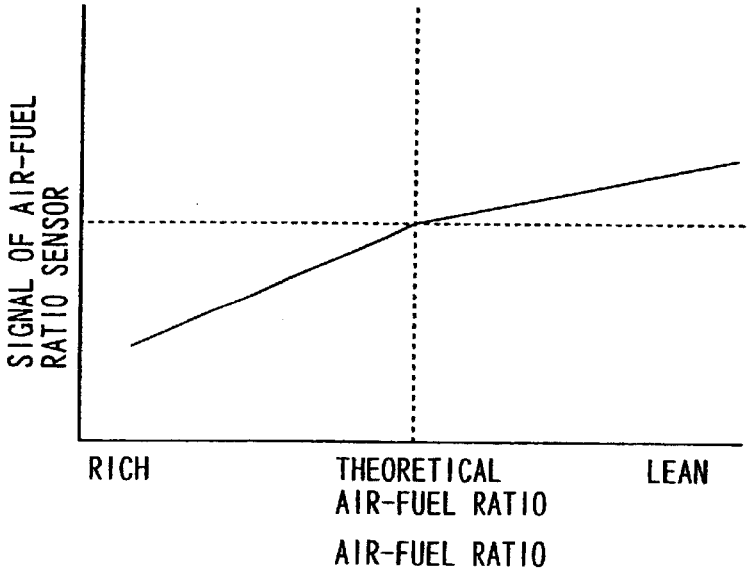
FIG. 3 is a diagram showing the relationship between air-fuel ratio and signal of an air-fuel ratio sensor.

FIG. 3 shows the relationship between air-fuel ratio and signal of the air-fuel ratio sensor 6. The air-fuel ratio sensor 6 can detect air-fuel ratios widely and continuously from rich to lean, and is also called as a wide air-fuel ratio sensor. The air-fuel ratio of the supplied mixed gas is feedback controlled based on a real air-fuel ratio detected by the air-fuel ratio sensor 6 so that an air-fuel ratio of the engine becomes a target air-fuel ratio.

For instance, in a case where the catalyst 13 is a ternary catalyst which cleans harmful components by oxidation-reduction reaction, the air-fuel ratio needs to be maintained at a value near the theoretical air-fuel ratio in order to attain a sufficient cleaning efficiency. Therefore, the air-fuel ratio of the supplied mixed gas is feedback controlled based on the real air-fuel ratio detected by the air-fuel ratio sensor 6 so that the engine is operated under a condition of the theoretical air-fuel ratio.

Description will be made below on the time lag in detection of an air-fuel ratio from the time when fuel is injected by the injector 8 and supplied to the engine 1 to the time when an air-fuel ratio signal is produced by the air-fuel ratio sensor 6. The time lag is caused, for example, by that a part of fuel injected from the injector 8 is attached on an inside wall of the air intake pipe 21 and then gradually flows into the combustion chamber 20*a*. Further, the air-fuel ratio sensor 6 itself has a time lag in detection. In addition, a signal of the air-fuel sensor 6 is generally passed through a hardware or software filter before being used, and this filter also produces a time lag.

The time lag described above can be approximated, for example, by a first-order time lag or a second-order time lag. The other time lags are determined by the time until the fuel injected by the injector 8 is transported to the inlet of the combustion chamber 20*a*, and the time from entering of the fuel into the combustion chamber 20*a* to be burned to exhaustion of the burned gas (in a case of a 4 stroke engine, approximately 2 rotations of the crank shaft), and the time until the exhaust gas exhausted from the combustion chamber 20*a* is transported up to an arranged position of the air-fuel ratio sensor 6.

The time lag is affected by an operating condition of the engine 1. It depends on the arranged positions of the injector and the air-fuel ratio sensor, and it is also determined, for example, by a rotation speed and a load of the engine or an amount of intake air. Further, when the engine is cool, the time lag becomes large. This can be estimated, for example, from a temperature of the cooling water. Furthermore, the time lag may be varied by a temperature of the air-fuel ratio sensor 6 itself. In addition, since the time lag is varied by a characteristic of the fuel used, it is preferable to provide a fuel property detecting means to estimate the change in time lag corresponding to the detected result. Further, since the time lag becomes large when deposit is attached onto the intake valve of the engine 1, it is preferable to estimate the effect from, for example, a driving distance or a cumulative value of fuel injection amount.

Figure 4:
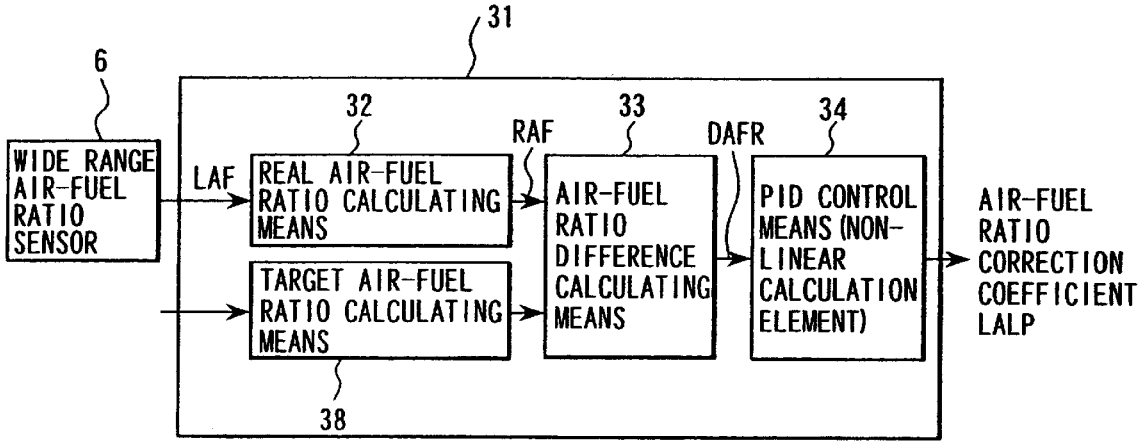
FIG. 4 is a control block diagram showing an air-fuel ratio correction coefficient calculating means of the air-fuel ratio controller for an engine of FIG. 1.

FIG. 4 is a control block diagram showing the functional configuration of the air-fuel ratio correction coefficient calculating means 31 of the present embodiment of the air-fuel ratio controller for an engine of FIG. 1. The air-fuel ratio correction coefficient calculating means 31 composing the air-fuel ratio controller comprises a real air-fuel ratio calculating means 32, a target air-fuel ratio calculating means 38, an air-fuel ratio difference detecting means 33 and a PID control means 34.

The real air-fuel ratio calculating means 32 calculates a real air-fuel ratio RAF based on an output signal of the air-fuel ratio sensor 6, and the target air-fuel ratio calculating means 38 calculates a target air-fuel ratio based on an output signal of an accelerator pedal or the like. The air-fuel ratio difference detecting means 33 calculates an air-fuel ratio difference DAFR from the target air-fuel ratio and the real air-fuel ratio RAF. In the PID control means 34, PID control based on a non-linear calculation element is performed based on the air-fuel ratio difference DAFR to calculate an air-fuel ratio correction coefficient LALP. The present embodiment of the air-fuel ratio controller for engine controls the air-fuel ratio of the engine by adjusting an amount of supplied fuel based on the calculated air-fuel ratio correction coefficient LALP.

Figure 5:
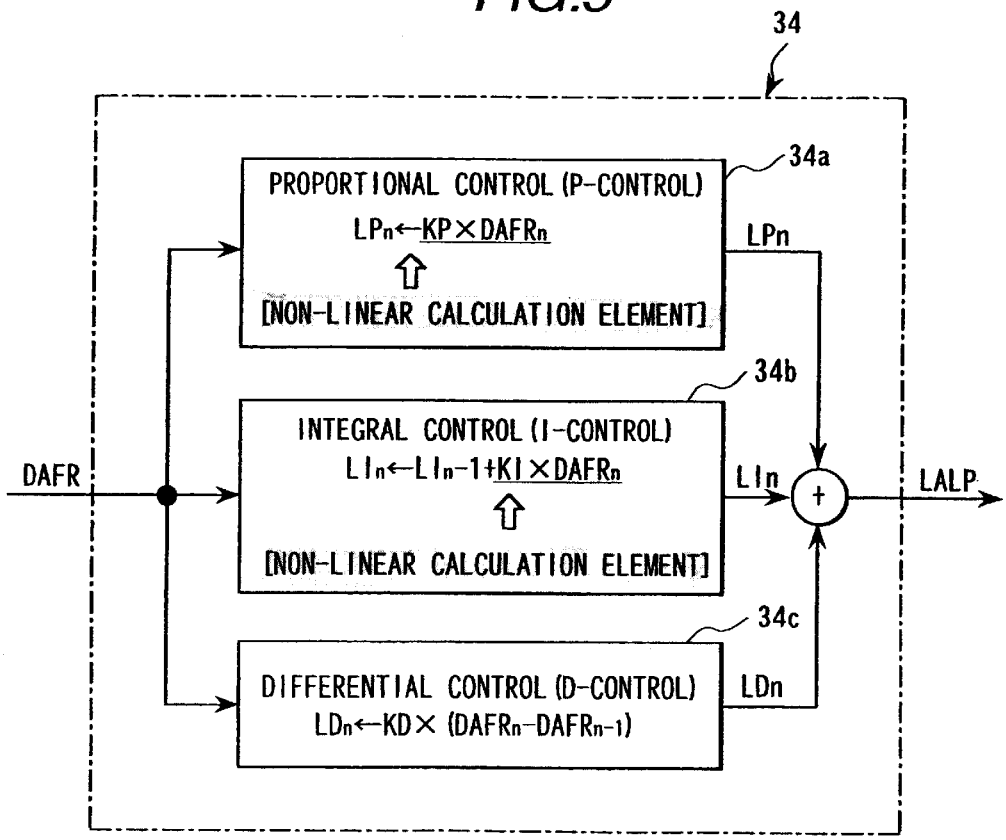
FIG. 5 is a block diagram showing the control contents of a PID control means by non-linear calculation elements of the air-fuel ratio correction coefficient calculating means of FIG. 4.
Figure 6A:
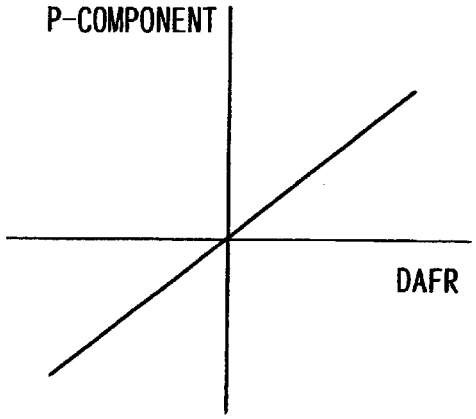
FIG. 6 is diagrams explaining a linear calculation element and non-linear calculation elements of proportional control (P-component control) of the PID control means.
Figure 6D:
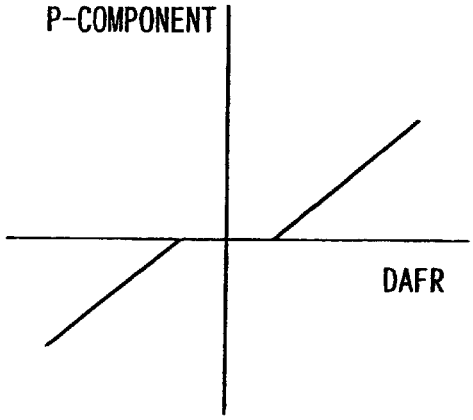
Figure 6B:
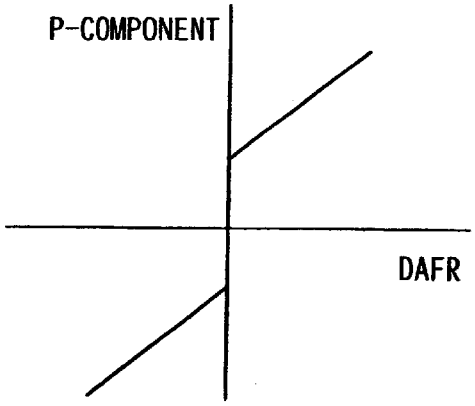
Figure 6E:
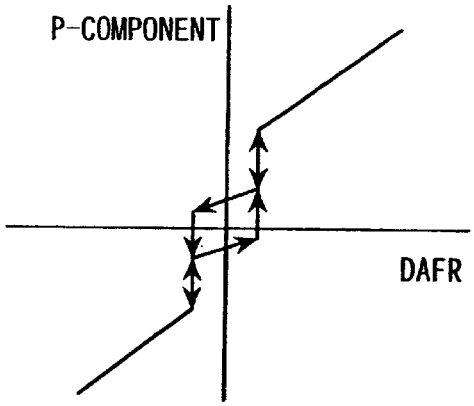
Figure 6C:
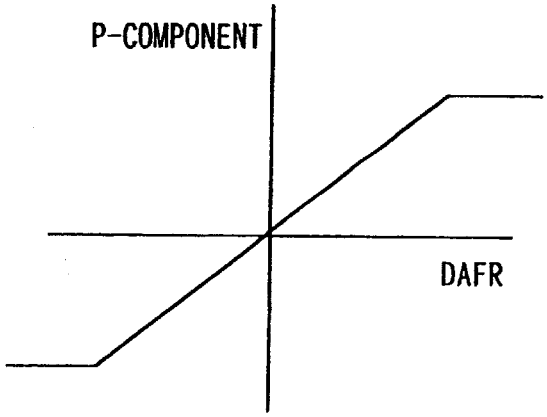

FIG. 5 is a control block diagram showing the details of the PID control means 34. The PID control means 34 comprises three control means of a proportional control (P-control) 34*a*, an integral control (I-control) 34*b* and a differential control (D-control) 34*c*. The PID control means 34 calculates the air-fuel ratio correction coefficient LALP described above which is obtained by respectively calculating three values by the three control means using the air-fuel ratio difference DAFR and adding the three values.

The calculated values of the three control means, that is, a proportional component (P-component) calculated value LP, an integral component (I-component) calculated value LI and a differential component (D-component) calculated value LD are calculated as follows, where an air-fuel ratio difference is let be DAFR, and control gains are let be KP, KI, KD.

$$LP_n \leftarrow KP \times DAFR_n \tag{1}$$

$$\Delta LI_n \leftarrow KI \times DAFR_n \tag{2}$$

$$LI_n \leftarrow LI_{n-1} \times \Delta LI_n \tag{2'}$$

$$LD_n \leftarrow KD \times (DAFR_n - DAFR_{n-1}) \tag{3}$$

Then, the air-fuel ratio correction coefficient LALP can be obtained by adding the calculated values $LP_n$, $LI_n$, $LD_n$, that is, $$LALP \leftarrow LP_n + LI_n + LD_n \tag{4}$$

Figure 7A:
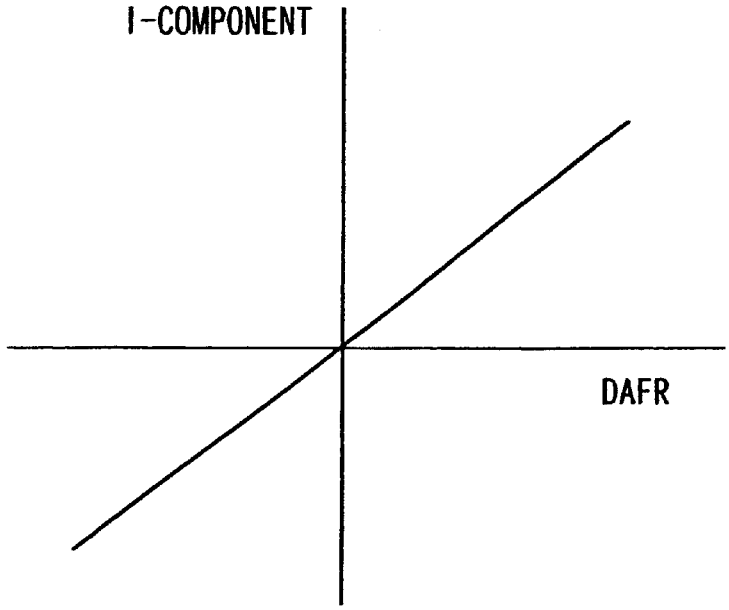
FIG. 7 is diagrams explaining a linear calculation element and a non-linear calculation element of integral control (I-component control) of the PID control means.
Figure 7B:
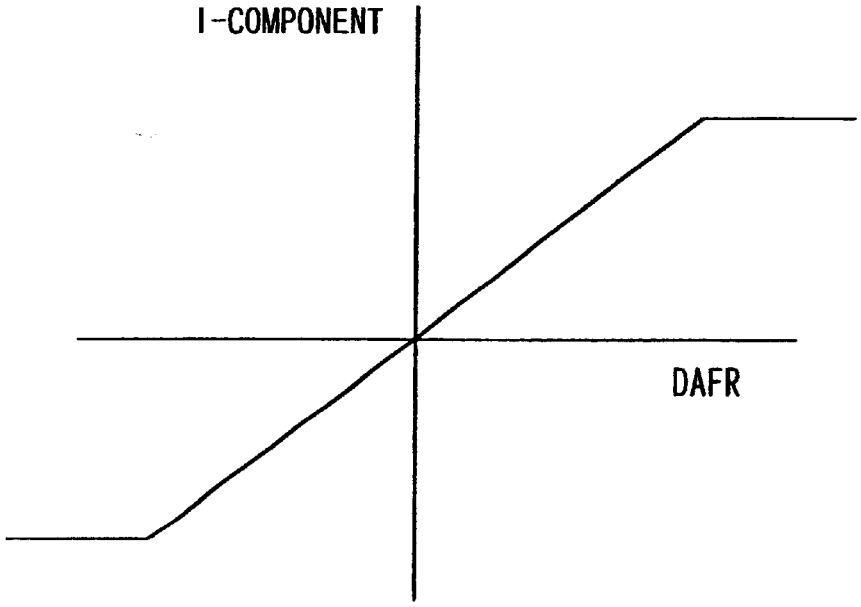
Figure 8A:
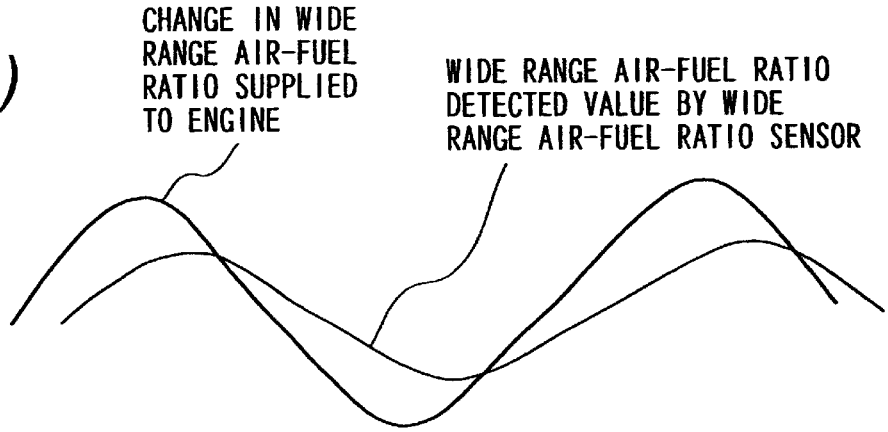
FIG. 8 is charts showing the relationship among air-fuel ratio supplied to an engine, detected air-fuel ratio and air-fuel ratio correction.
Figure 8B:
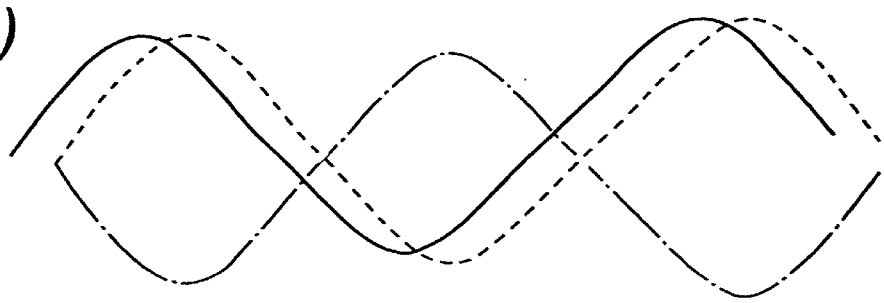
Figure 8C:
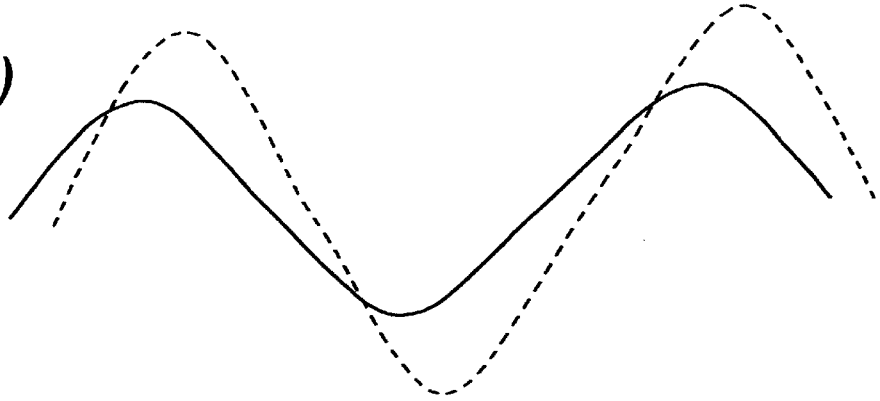
Figure 8D:
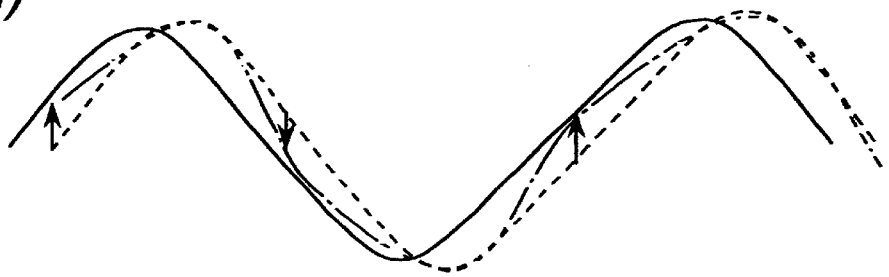

In the conventional PID control, a proportional component (P-component) calculated value LP is obtained from a linear calculation element of FIG. 6(*a*) and an integral component (I-component) calculation element $\Delta LI_n$ is obtained from a linear calculation element of FIG. 7(*a*). However, in the PID control of the present embodiment, a proportional component (P-component) calculated value LP is obtained from non-linear calculation elements of FIG. 6(*b*)~(*e*) and an integral component (I-component) calculation element $\Delta LI_n$ is obtained from a non-linear calculation element of FIG. 7(*b*). Description will be made below on difference between obtaining the calculated values LP, LI from the linear calculation elements and from the non-linear calculation elements, and an advantage of the PID control based on the non-linear calculation elements of the present embodiment.

FIG. 8 shows a change in an air-fuel ratio supplied to the engine, an output of the wide range air-fuel ratio sensor and a state of correcting an air-fuel ratio.

Bold solid lines in FIG. 8(*a*) to (*d*) show the change in the air-fuel ratio supplied to the engine, and a thin solid line in FIG. 8(*a*) shows the output of the wide range air-fuel ratio sensor arranged in the exhaust gas system. The output of the wide range air-fuel ratio sensor has a time lag to the change in the air-fuel ratio supplied to the engine, and the amplitude of the output is averaged to become small, as described previously.

In a case where the air-fuel ratio control by the PDI control is performed by inputting the output of the wide range air-fuel ratio sensor, when the proportional component (P-component) calculated value LP is calculated by the linear calculation element of FIG. 6(*a*) and the integral component (I-component) calculated value LI is calculated by the linear calculation element of FIG. 7(*a*), the control shown by a dashed line in FIG. 8(*b*) is performed. (Although the actual result becomes a waveform (shown by a chain line) which is symmetric to the waveform shown by the dashed line in FIG. 8(*b*) with respect to the center line, the control is shown by a dashed line in FIG. 8(*b*) in order to make the phase difference clearer.) It can be considered that a means for solving the time lag in control is to increase a control gain under the characteristics of FIG. 6(*a*) and FIG. 7(*a*). However, in this case, a problem such as increase of overshoot or occurrence of oscillation may be occur.

By introducing the non-linear calculation elements as shown by FIG. 6(*b*), (*e*) into the proportional component (P-component) control, the time lag in control can be corrected without increasing the control gain, as shown by a chain line in FIG. 8(*d*). Arrows in FIG. 8(*d*) show improved points by introducing the non-linear calculation element of FIG. 6(*b*) in taking the control constant of FIG. 8(*b*) as the base (the dashed line).

FIG. 6(*c*) and FIG. 7(*b*) are non-linear calculation elements having saturation characteristics in the P-component and the I-component of the PID control which have an effect to prevent occurrence of a problem such as oscillation of the control system due to a large control gain when the air-fuel ratio difference DAFR falls in the saturation characteristic ranges.

FIG. 6(*d*) is a non-linear calculation element having a neutral zone in the P-component of the PID control which has an effect to prevent very small vibration in the air-fuel ratio caused by operation of the P-component to a very small air-fuel ratio difference DAFR. FIG. 6(*e*) is a non-linear calculation element having a hysteresis characteristic (a characteristic combining a plurality of characteristics selected from the group consisting of an ON-OFF characteristic, a neutral zone characteristic and a saturation characteristic) and having a structure suppressing the change of the P-component at the air-fuel ratio difference near zero (DAFR=0) in taking the characteristic of FIG. 6(*b*) as the base. The non-linear calculation element having a hysteresis characteristic has an effect to prevent occurrence of hunting in the air-fuel ratio at the air-fuel ratio difference near zero (DAFR=0) and also has the effect of FIG. 8(*d*).

Further, a conversion efficiency of a ternary catalyst is likely increased, for example, when the air-fuel ratio input to the ternary catalyst is perturbed near the theoretical air-fuel ratio. Therefore, by introducing a non-linear calculation element represented by FIG. 6(*b*) or FIG. 6(*e*), the performance of the catalysts can be used at maximum by producing the perturbation.

Figure 9:
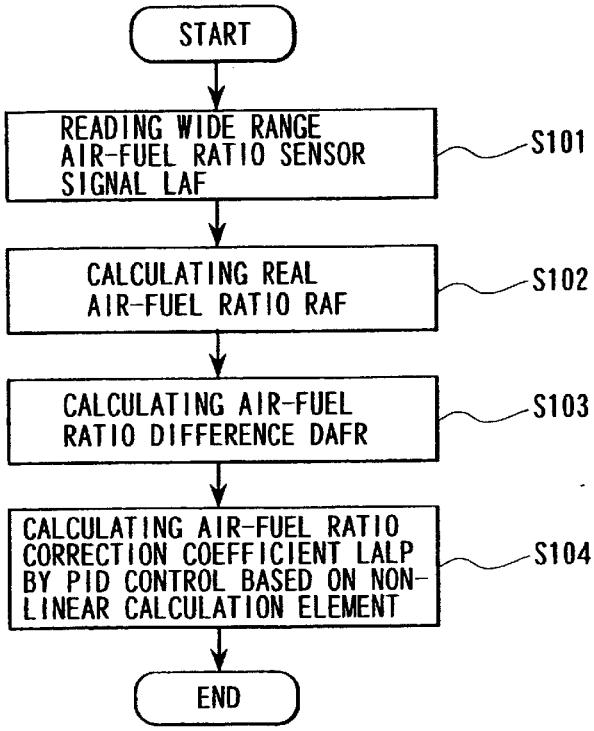
FIG. 9 is a control flow chart of the air-fuel ratio correction coefficient calculating means of FIG. 4.

FIG. 9 is a control flow chart showing the processing of the air-fuel ratio correction coefficient calculating means of the present embodiment of the air-fuel ratio controller for engine.

The control processing is executed every preset time interval (for instance, every 10 ms), and initially an output signal LAF from the wide air-fuel ratio sensor 6 is read, in Step 101. It is preferable that the processing of Step 101 is executed in a faster cycle (1 to 2 ms) and the signal is filtered. Next, in Step 102, a real air-fuel ratio is retrieved according to the output signal LAF. Therein, the characteristic of the wide range air-fuel ratio sensor 6 shown in FIG. 3 is stored in the ROM 25 of the EUC 7, and the real air-fuel ratio can be obtained from table retrieval. In Step 103, an air-fuel ratio difference DAFR is calculated from the real air-fuel ratio RAF and the target air-fuel ratio using the equation of (air-fuel ratio difference DAFR)=(real air-fuel ratio RAF)−(target air-fuel ratio). Then, in Step 104, an air-fuel ratio correction coefficient LALP is calculated by the PID control based on the non-linear calculation element from the air-fuel ratio difference DAFR, and thus the processing flow is completed.

Although the embodiment in accordance with the present invention has been described above, it is understood that the present invention is not limited to the embodiment described above and various changes and modifications may be made in the design without departing from the spirit of the invention described in the claims.

For example, in the above-mentioned embodiments, the various kinds of non-linear calculation elements are introduced mainly into the P-component control of the PID control. However, a similar effect can be obtained by introducing various kinds of non-linear calculation elements into the I-component control.

Further, in the above-mentioned embodiments, the air-fuel ratio correction coefficient is calculated by obtaining the calculated values by performing calculations of the air-fuel ratios using three control means of the proportional control (P-control), the integral control (I-control) and the differential control (D-control) in the PID control, respectively, and then adding the calculated values. However, it is possible to obtain the calculated values by any one of the above-mentioned three control means, or by two out of the above-mentioned three control means (for example, PI control or the like) and then calculate the air-fuel ratio correction coefficient based on the calculated values.

Furthermore, in the embodiment described above, the air-fuel ratio correction coefficient is calculated by employing the various kinds of non-linear calculation elements in the PID control. However, it is possible to calculate the air-fuel ratio correction coefficient by using a control means other than the PID control and employing the non-linear calculation elements in the control means.

Still further, as shown in FIG. 1, by detecting an air-fuel ratio by the $O_2$ sensor arranged downstream of the catalyst 13 and correcting the non-linear calculation element of the P-component control shown in FIG. 6 based on the detected value, it is possible to realize air-fuel ratio control optimized to the catalyst 13 and to correct a time lag in detection of air-fuel ratio in the wide range air-fuel ratio sensor caused by running of long duration.

Figure 10:
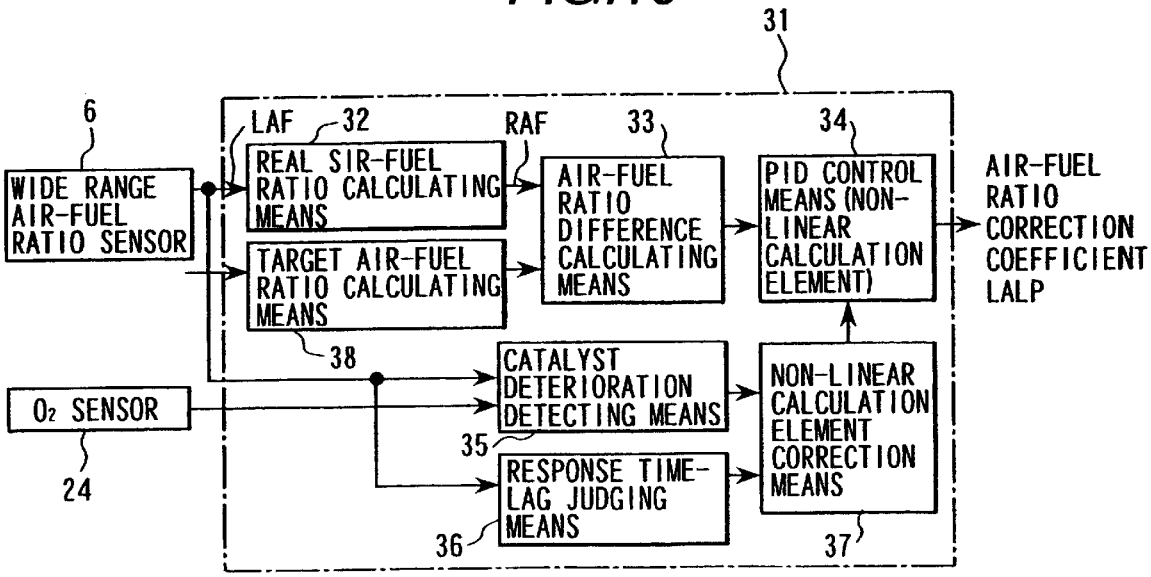
FIG. 10 is a control block diagram of another embodiment of an air-fuel ratio correction coefficient calculating means of an engine air-fuel ratio controller in accordance with the present invention.

FIG. 10 is a control block diagram of another embodiment of an engine air-fuel ratio controller which is constructed by adding a means for correcting the abovementioned non-linear calculation elements to the control block diagram of the air-fuel ratio correction coefficient calculating means 31 of FIG. 4. Referring to FIG. 10, a catalyst deterioration detecting means 35 evaluates and judges deterioration of the catalyst 13, that is, the conversion efficiency of the catalyst 13 based on detected values of the wide range air-fuel ratio sensor 6 and the $O_2$ sensor 24, and outputs the judged result to a non-linear calculation element correcting means 37. The non-linear calculation element correcting means 37 corrects the non-linear calculation element based on the judged result. By the correction, the air-fuel ratio coefficient to be calculated by the PID control means is changed, and consequently it is possible to minimize deterioration of the exhaust gas condition of the exhaust gas discharged from the downstream side of the catalyst 13 caused by deterioration of the catalyst 13.

On the other hand, a response time lag judging means 36 judges a response time lag of the wide range air-fuel ratio sensor 6, and output the judged result to the non-linear calculation element correcting means 37. The non-linear calculation element correcting means 37 corrects the non-linear calculation element based on the judged result. By the correction, the air-fuel ratio coefficient to be calculated by the PID control means is changed, and consequently it is possible to prevent deterioration of the exhaust gas condition due to mismatching of the air-fuel ratio correction coefficient. For example, since an amount of deposit in an intake pipe of an engine is generally increased when the vehicle runs for long duration, an amount of fuel attached to the intake pipe is increased and the time lag in detecting an air-fuel ratio detected by the wide range air-fuel ratio sensor 6 is caused. This time lag can be corrected by correcting the non-linear calculation element.

It can be understood from the above description that by employing the non-linear calculation element in the control such as the PID control system at calculating the air-fuel ratio correction coefficient, the air-fuel ratio controller for the engine in accordance with the present invention can compensate the time lag in detecting an air-fuel ratio by the wide range air-fuel ratio sensor from the time when fuel is supplied to the intake pipe side. Therefore, the response of the air-fuel ratio correction control can be improved and the emission from the engine can be reduced.

What is claimed is:

1. An air-fuel ratio controller for an engine comprising a wide range air-fuel ratio sensor for outputting a signal having a value proportional to an air-fuel ratio of an exhaust gas; and a calculating component for calculating an air-fuel ratio correction coefficient to control an amount of fuel supplied to the engine based on an output signal of said air-fuel ratio sensor, wherein said calculating component calculates the air-fuel ratio correction coefficient based on a non-linear calculation element.

2. An air-fuel ratio controller for an engine according to claim 1, wherein said non-linear calculation element has a characteristic combining a plurality of characteristics selected from the group consisting of an ON-OFF characteristic, a neutral zone characteristic and a saturation characteristic.

3. An air-fuel ratio controller for an engine according to claim 1, wherein said air-fuel ratio correction coefficient calculating component has a non-linear calculation element correcting component, and said non-linear calculation element correcting component corrects said non-linear calculation element based on an output signal of an $O_2$ sensor arranged downstream of a catalyst.

4. An air-fuel ratio controller for an engine according to claim 1, wherein said air-fuel ratio correction coefficient calculating component has a non-linear calculation element correcting component, and said non-linear calculation element correcting component corrects said non-linear calculation element based on a time lag in response of said wide range air-fuel ratio sensor.

* * * * *